US009017106B2

(12) United States Patent
Heppner et al.

(10) Patent No.: US 9,017,106 B2
(45) Date of Patent: Apr. 28, 2015

(54) CONNECTOR ASSEMBLY AND METHODS WITH INTEGRATED PITCH TRANSLATION

(71) Applicant: Intel Corporation, Santa Clara, CA (US)

(72) Inventors: Joshua D Heppner, Chandler, AZ (US); Gaurav Chawla, Tempe, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 13/826,393

(22) Filed: Mar. 14, 2013

(65) Prior Publication Data

US 2014/0273662 A1 Sep. 18, 2014

(51) Int. Cl.

| | |
|---|---|
| ***H01R 24/86*** | (2011.01) |
| ***H01R 24/60*** | (2011.01) |
| ***H01R 43/00*** | (2006.01) |
| *H01R 12/72* | (2011.01) |
| *H01R 12/79* | (2011.01) |
| *H01R 107/00* | (2006.01) |

(52) U.S. Cl.

CPC ..... *H01R 24/86* (2013.01); *H01R 12/724* (2013.01); *H01R 12/727* (2013.01); *H01R 12/79* (2013.01); *H01R 24/60* (2013.01); *H01R 2107/00* (2013.01); *H01R 43/00* (2013.01)

(58) Field of Classification Search

USPC ..... 439/682, 685, 465, 405, 404, 660, 439/540.1

See application file for complete search history.

(56) References Cited

U.S. PATENT DOCUMENTS

| | | | | |
|---|---|---|---|---|
| 4,410,230 A | | 10/1983 | Sanmiguel | |
| 5,186,660 A | * | 2/1993 | Wielgos et al. | 439/685 |
| 5,667,401 A | * | 9/1997 | Kuwabara et al. | 439/405 |
| 6,007,374 A | * | 12/1999 | Sukegawa | 439/540.1 |
| 7,059,892 B1 | * | 6/2006 | Trout | 439/465 |
| 7,137,848 B1 | * | 11/2006 | Trout et al. | 439/465 |
| 8,562,374 B2 | * | 10/2013 | Myer et al. | 439/404 |

(Continued)

FOREIGN PATENT DOCUMENTS

| | | |
|---|---|---|
| DE | 102005062436 A1 | 7/2007 |
| EP | 1133003 A2 | 9/2001 |
| JP | 10247566 A | 9/1998 |

OTHER PUBLICATIONS

"European Application Serial No. 14158392.2, Extended European Search Report mailed Aug. 14, 2014", 3 pgs.

(Continued)

*Primary Examiner* — Alexander Gilman

(74) *Attorney, Agent, or Firm* — Schwegman Lundberg & Woessner, P.A.; Nathan D. Ellefson

(57) ABSTRACT

This disclosure relates generally to a connector assembly. In various examples, first conductive members are secured with respect to one another and form a first row and second conductive members are secured with respect to one another, a first subset of the second conductive members forming a second row and a second subset of the second conductive members forming a third row, the second and third rows being parallel and stacked with respect to one another and the second and third rows being orthogonal to the first row. Individual ones of the first and second conductive members are arranged to be coupled at a first end to a corresponding one of contacts. Ones of the first conductive members are arranged to be coupled to a corresponding individual one of the second conductive members proximate a second end of each of the first and second conductive members.

21 Claims, 9 Drawing Sheets

(56) References Cited

U.S. PATENT DOCUMENTS

| | | | | |
|---|---|---|---|---|
| 8,715,003 | B2 * | 5/2014 | Buck et al. | 439/607.07 |
| 2006/0094304 | A1 | 5/2006 | Masaki et al. | |
| 2006/0141849 | A1 * | 6/2006 | Trout | 439/465 |
| 2006/0154514 | A1 * | 7/2006 | Trout et al. | 439/465 |
| 2007/0026721 | A1 * | 2/2007 | Whyne et al. | 439/358 |
| 2012/0270433 | A1 * | 10/2012 | Myer et al. | 439/404 |

OTHER PUBLICATIONS

"Korean Application Serial No. 2014-0029674, Notice of Preliminary Rejection mailed Oct. 29, 2014", w/English Translation, 15 pgs.

* cited by examiner

CONNECTOR ASSEMBLY AND METHODS WITH INTEGRATED PITCH TRANSLATION

TECHNICAL FIELD

The disclosure herein relates generally to a connector assembly with integrated pitch translation.

BACKGROUND ART

Electronic packages have long utilized a variety of modes for transmitting and receiving information between a die contained within the package and electronic devices outside of the package. Electrical interconnects provide electrical connectivity within the package between the die and the various communication components that can be utilized to transmit and receive electronic signals from and to the die. One such communication component is a conventional socket-connected solder bump, configured to create a physical electrical connection between the package and another electronic device that via a motherboard or other circuit board. Another such communication component is a cable connector that permits communication between the die and an external electronic device without respect to a motherboard.

DESCRIPTION OF THE EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Conventionally, communication via a circuit may provide for relatively small size requirements for the communication interface in comparison with cable connection. Circuit board-based communication may utilize half or less of the space on a chip package to provide the physical interface for the electrical connection than conventional cable communication. However, certain uses of chip packages on circuit boards has resulted in circuit boards becoming relatively crowded, limiting the potential for placing additional electronic communication lines within the circuit board. Additionally, the electronic communication lines in a circuit board may be relatively slow in comparison with certain cable communication lines, such as coaxial cables.

However, while cable communication lines, such as coaxial cables, provide advantages in data rate and avoiding crowding on circuit boards, certain cables, including coaxial cables, are also relatively thick. Factoring in both the communicative element and insulation, a pitch between adjacent cables can be two or more times greater than the minimum pitch of the connectors on the chip package to which the cables may be connected. In other words, while the connectors on the chip package may be designed with fabrication technology that would permit a certain minimum pitch, the characteristics of contemporary cables may result in the connectors on the chip package necessarily being spaced with a pitch larger than the minimum pitch in order to provide enough space to couple with the cables.

A connector has been developed that allows for the use of both relatively high-gauge cables as well as low-pitch connectors on a chip package. The connector utilizes a pitch translation, such as in the vertical direction, that permits a first pitch on the chip package and a second, larger pitch on the cable side. The connector may include discrete vertical and horizontal elements that interact at ninety (90) degree angles, which may produce comparatively simple manufacturing processes and reliability.

Figure 1:
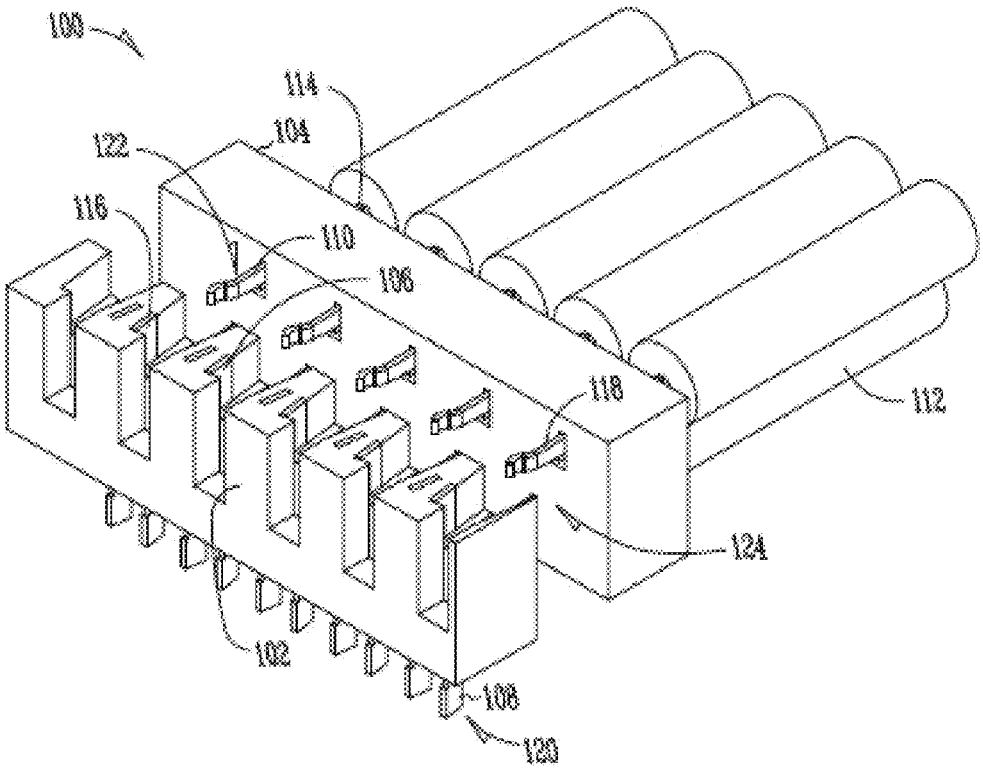
FIG. 1 is an image of a connector assembly.

FIG. 1 is an image of a connector assembly 100. The connector assembly 100 includes a chip package-side connector 102 and a cable-side connector 104. The package-side connector 102 includes first conductive members 106 secured with respect to one another by and extending through the package-side connector 102. The conductive members 106 are configured to electrically couple at a first end 108 with connectors on a chip package (not pictured). The cable-side connector 104 includes second conductive members 110 that are secured with respect to one another by the connector 104 and that are each coupled to a cable 112 at a first end 114 of the conductive members 110. As illustrated, the cable 112 is a cable with multiple conductors 115.

The first and second conductive members 106, 110 are configured to electrically couple to one another at interface surfaces proximate the second ends 116, 118 of the conductive members 106, 110, respectively. As illustrated, the connectors 102, 104 are configured to mechanically engage with one another. Upon the connectors 102, 104 being mechanically engaged, various conductive members 106, 110 mechanically and electrically engage with respect to one another, creating electrical connectivity between a chip package connector and a corresponding one of the cables 112.

As will be detailed herein, the first conductive members 106 are substantially contained within a first row 120, such as that extends orthogonally from the chip package. Stated another way, in an example, the first conductive members 106 extend substantially orthogonally from a major surface of the chip package and, while the conductive members 106 may bend or deviate laterally within a major plane defined by the row, the conductive members 106 do not substantially deviate outside of the major plane of the row, such as, in the orientation illustrated in FIG. 1, by bending or otherwise deviating toward or away from the cable-side connector 104. As illustrated, each of the first conductive members 106 are contained only within the row 120. As illustrated, the first conductive members 106 form a single row.

As will be further discussed herein, each of the second conductive members 110 are part of one or the other, but not both, of a first and second subset of the second conductive members. The first and second subsets are, respectively, wholly contained within a second and third row 122, 124 (obscured; see FIG. 2). It is noted and emphasized that, while two rows 122, 124 are illustrated, the principles articulated herein allow for scaling to any number of row, both with respect to the first conductive members 106 and the second conductive members 110. As with the first conductive members 106, the second conductive members 110 may deviate within major planes defined by their respective rows 122, 124, but do not substantially bend or deviate outside of the major planes, such as, in the orientation of FIG. 1, orthogonal to the major plane of the first row 120.

As will be illustrated in detail herein, the first conductive members 106 in a single row interface with the second conductive members 110 in a double row by incorporating variant lengths between ones of the first conductive members 106, such as alternating lengths. Consequently, although the conductors 115 of the cable 112 have a pitch twice that of the first conductive members 106, the connector assembly 100 remains both relatively compact and mechanically simple. The relatively compact and mechanically simple assembly 100 may result in reduced footprint on a chip package as well as decreased signal loss over more complex connectors. The relatively compact design may also provide for more space over the connector, such as for additional componentry related to the chip package.

Figure 2:
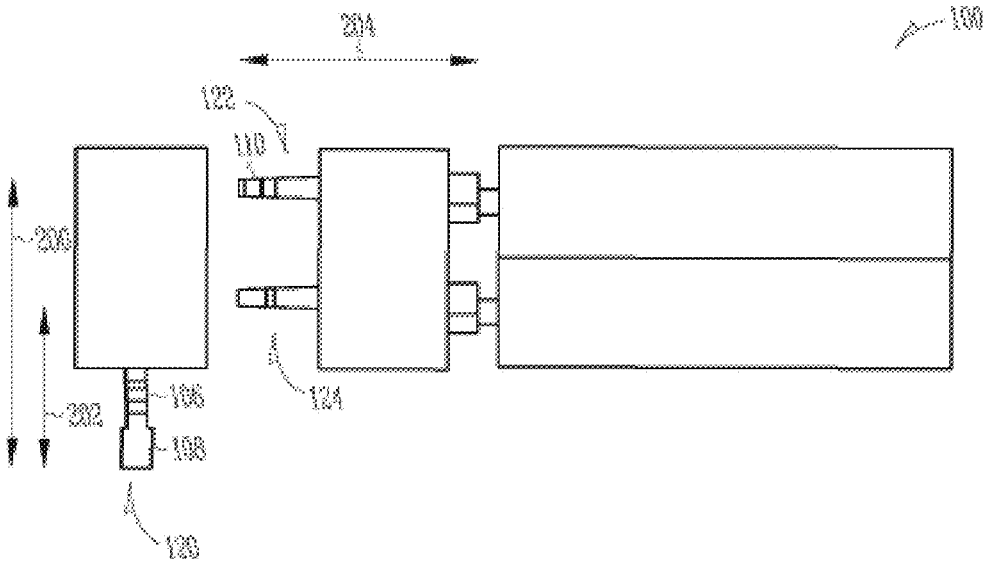
FIG. 2 is an end-on view of a connector assembly.

FIG. 2 is an end-on view of the connector assembly 100. One definition of the identity of the rows 120, 122, 124 is illustrated here. While, as illustrated herein, the conductive members 106, 110 may deviate within the plane various rows 120, 122, 124, the conductive members 106, 110 appear substantially coplanar from the end-on view. As illustrated, the first row 120 is orthogonal to the second and third rows 122, 124, while the second row 122 is parallel to the third row 124.

As will be illustrated herein, the first conductive members 106 variously have a common length 200 but variously positioned interface surfaces at the second ends 116 (obscured) that permit ones of the first conductive members 106 to mechanically and electrically engage with the ones of the second conductive members 110 on different rows 122, 124. Alternatively, the first conductive members have variant lengths 200, 202 that are substantially coextensive with distance from the first end 108 to the interface surface. By contrast, the second conductive members 110 may be of a substantially common length 204.

Figure 3A:
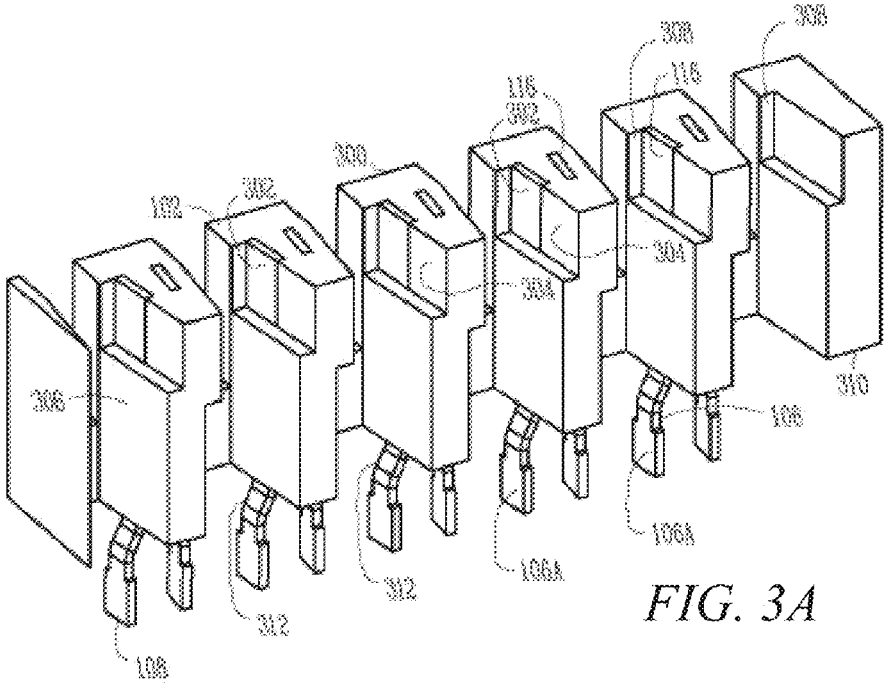
FIGS. 3A and 3B are profile images of the package-side connector.
Figure 3B:
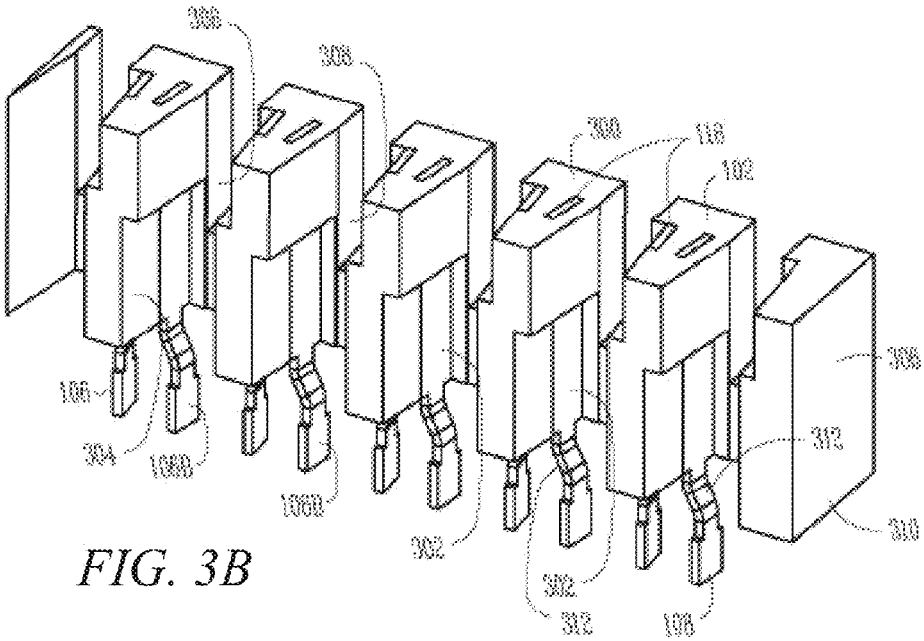

FIGS. 3A and 3B are profile images of the package-side connector 102. As illustrated, the first conductive members 106 have a common length 200, with each conductive member 106 extending from the first end to a top 300 of the connector 102. (It is noted, for instance, that, in the illustrated example, the second end 116 of conductive members 106 is visible at the top 300 of the connector 102.) However, while conductive members 106A have an interface surface 302 substantially at the second end 116 of the conductive members 106A, conductive members 106B have an interface surface 302 relatively lower on the conductive member 106B, albeit generally proximate the second end 116 in relation to the first end 108. In an alternatively example, the second end 116 of the conductive members 106 is coextensive or substantially coextensive with the interface surface 302.

As illustrated, the connector 102 includes notches 304 that expose the interface surfaces 302 and admit the second end 118 of the second conductive members 110. By contrast, some or all of the conductive members 106 that are not part of the interface surface 302 may be contained within the structure 306 of the connector 102. As illustrated, the connector 102 includes stop surfaces 308 configured to stop the second end 118 of the second conductive members 110 from advancing past the interface surface 302. In various examples, the bottom side 310 of the connector 102 is configured to be in contact or close to a major surface of a chip package.

As illustrated, each of the conductive members 106 includes a bend 312 configured to accommodate the corresponding notch 304 and permit electrical contact with the second conductive members 110. As illustrated, the bend 312 is within the plane of the row 120. In alternative examples, the conductive members 106 do not incorporate a bend 312 and instead are substantially linear.

Figure 4A:
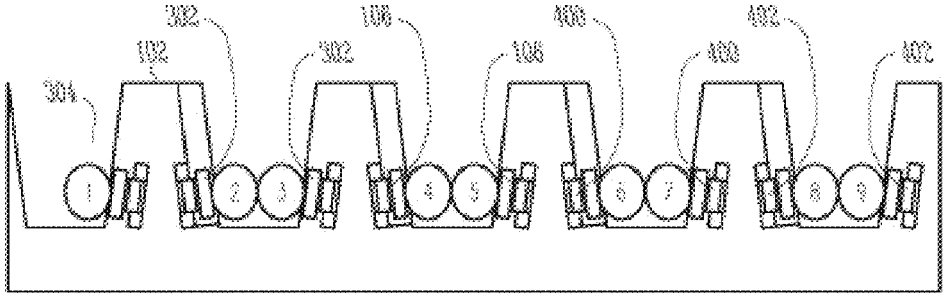
FIGS. 4A and 4B are a top view and a back cutaway view of the connector.
Figure 4B:
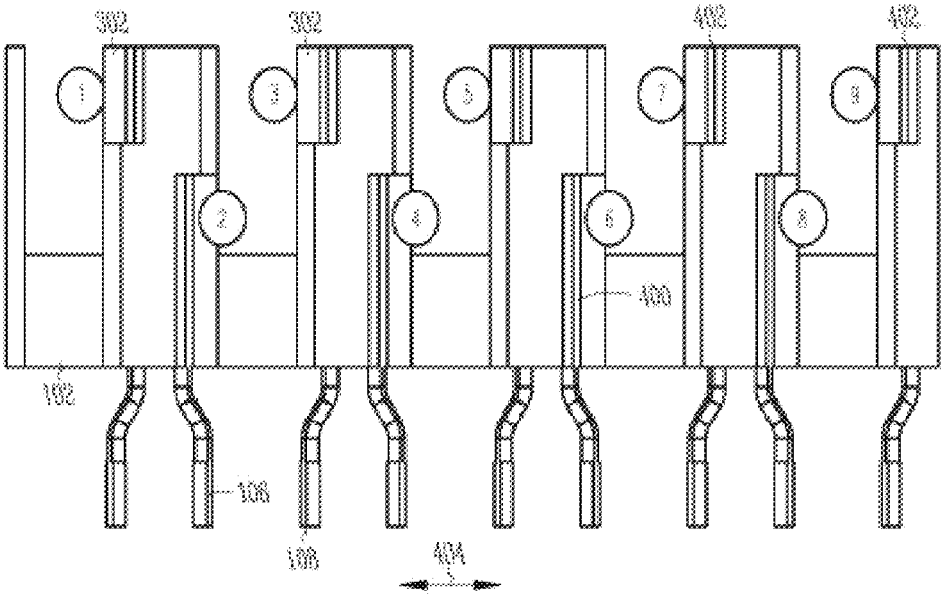

FIGS. 4A and 4B are a top view and a back cutaway view of the connector 102, respectively, and illustrate details of the conductive members 106. Like connectors 106 are labeled with the same numerals 1-9 between FIGS. 4A and 4B.

As illustrated, the conductive members 106 include interface surfaces 302 as separate components from the elongate members 400 that extend through the connector 102 and contact the connections on the chip package. In such an example, the interface surfaces 302 is connected to the elongate member 400, such as with a solder connection 402 or other standoff to place the interface surface 302 within the notch 304 of the connector 102.

As illustrated, the pitch between the conductive members 106 is defined by the distance 404 between adjacent conductive members 106 at the first end 108. As illustrated, the distance is approximately between adjacent conductive members 106. Alternatively, the pitch may be defined by an average distance 404 between adjacent conductive members 106 over connector 102 as a whole. In an example, the pitch for the conductive members is approximately 0.6 millimeters.

Figure 5A:
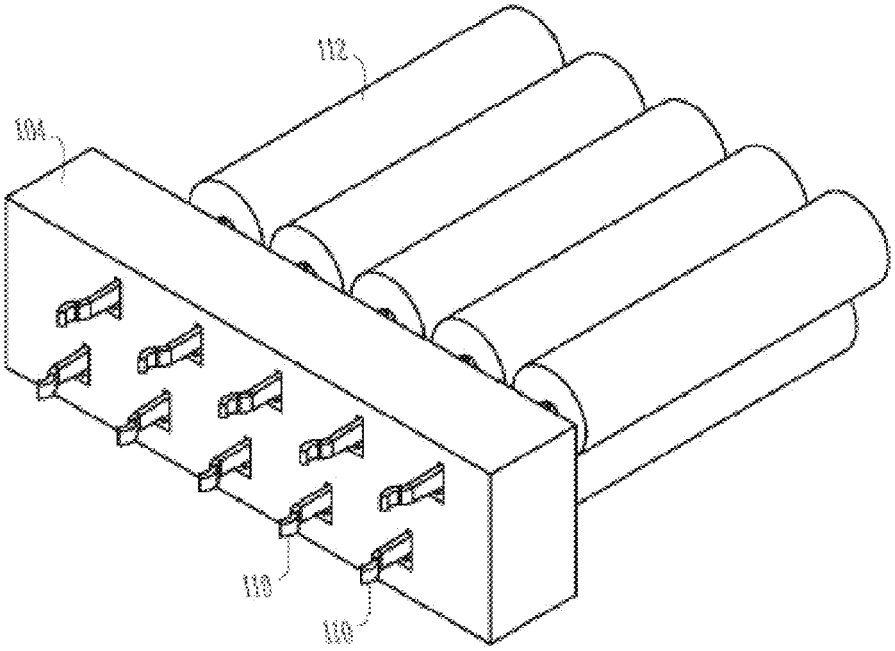
FIGS. 5A and 5B are a profile and end-on view of a cable-side connector and a cable.
Figure 5B:
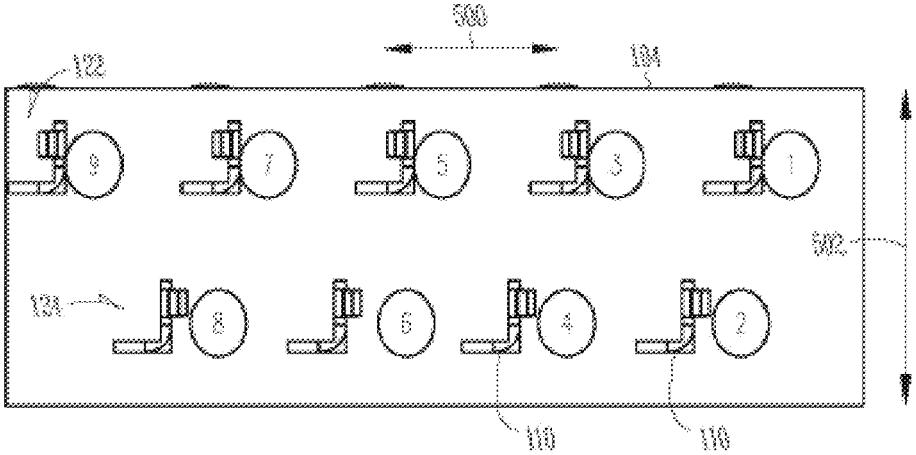

FIGS. 5A and 5B are a profile and end-on view of the cable-side connector 104 and the cable 112. The second conductive members 110 are numbered 1-9 as the second conductive members 110 would connect with the correspondingly numbered 1-9 first conductive members 106 of FIGS. 4A and 4B.

In an example, the cables 112 have a thickness of approximately 1.1 millimeters. In an example, the pitch for the second conductive members 110 is the distance 500 between adjacent conductive members in the same row 122, 124. In an example, the pitch of the second conductive members 110 is approximately 1.2 millimeters, e.g., slightly greater than the thickness of the cables 112. In various examples, the pitch of the second conductive members 110 is the same or substantially the same as the thickness of the cables 112.

As is illustrated, the second conductive members 110 are stacked with respect to one another between rows 122, 124. Such an arrangement may reduce a height 502 of the connector 104. Alternatively, the conductive members 110 may not be stacked with respect to one another between rows 122, 124, such as in circumstances where the cables 112 do not have a generally circular profile. In such circumstances, the pitch between rows 122, 124 may be the same as the pitch between the conductive members 110 within each row 122, 124.

The connector assembly 100 as illustrated includes two rows 122, 124 on the cable-side connector 104 in comparison with one row 120 on the package-side connector 102. It is to be understood that the principles that produce such a two-to-one ratio of rows may be readily applied to make connector assemblies 100 with alternative ratios of rows between the connectors 102, 104. For instance, a three-to-one ratio may be created by forming first conductive members 106 with interface surfaces 302 at three (3) lengths rather than the two (2) lengths 200, 202 illustrated herein. Such an arrangement may be utilized where the pitch between the first conductive members 106 is approximate one-third that of thickness of the cables 112. Further, examples where the package-side connector 102 utilizes multiple rows rather than a single row are also contemplated, such as to translate from two (2) rows on the package-side connector 102 to three (3) rows on the cable-side connector 104. Such principles are scalable to any of a variety of configurations.

It is to be emphasized and understood that although the connector assembly 100 is discussed with respect to use on a chip package herein, the connector assembly 100 and components thereof may have utility outside of the scope of chip packages. Various circumstances that may usefully utilize pitch translation and/or a turn in the assembly per the disclosure herein may utilize a connector assembly such as the connector assembly 100 or an alternative connector assembly that is consistent with the disclosure herein. It is further noted that the cables 112 may be replaced with various electrically conductive elements known in the art, such as another connector or connections on an alternative circuit board, electronic component, or the like.

Figure 6A:
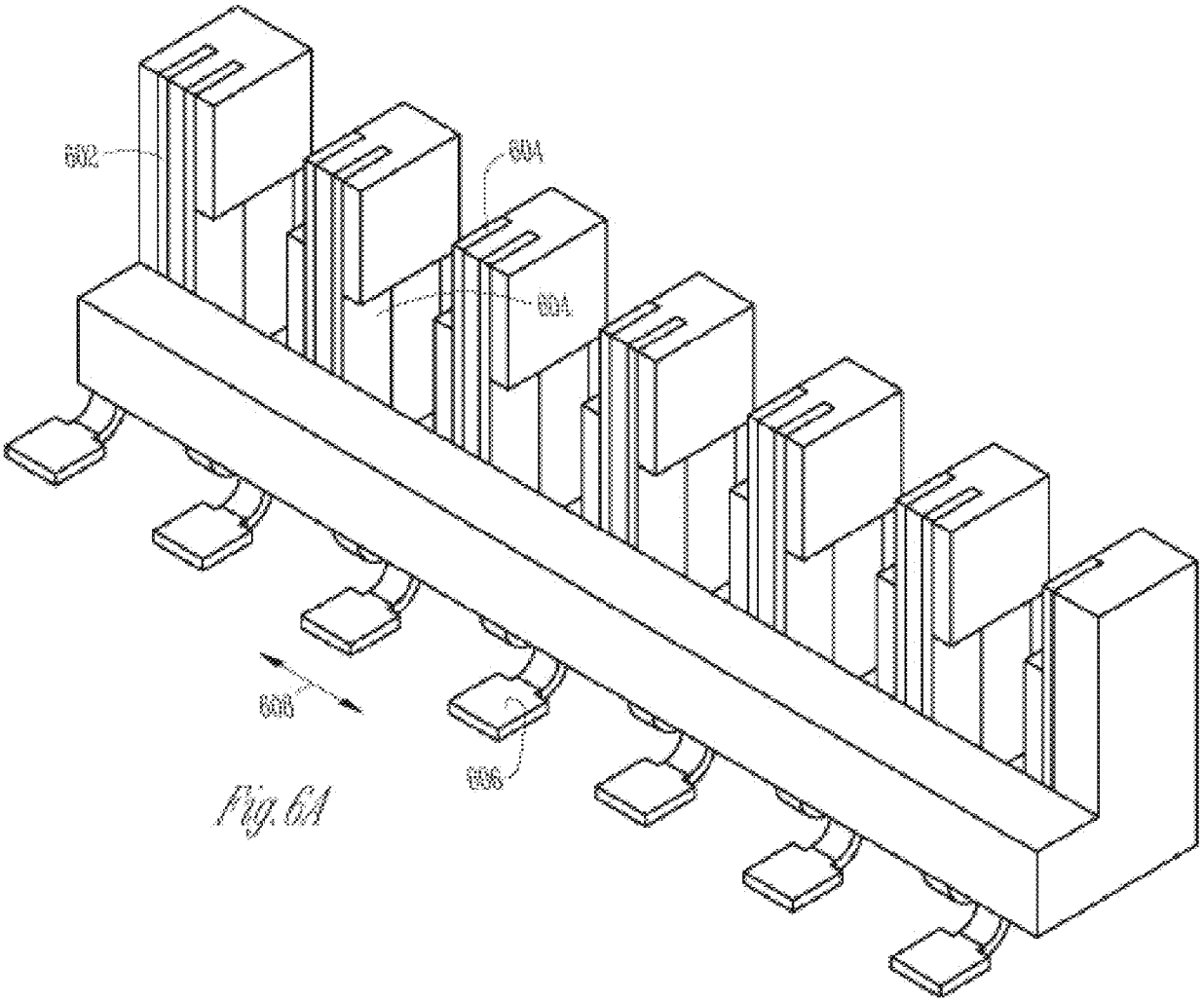
FIGS. 6A and 6B are images a connector assembly with a two-row package-side connector.
Figure 6B:
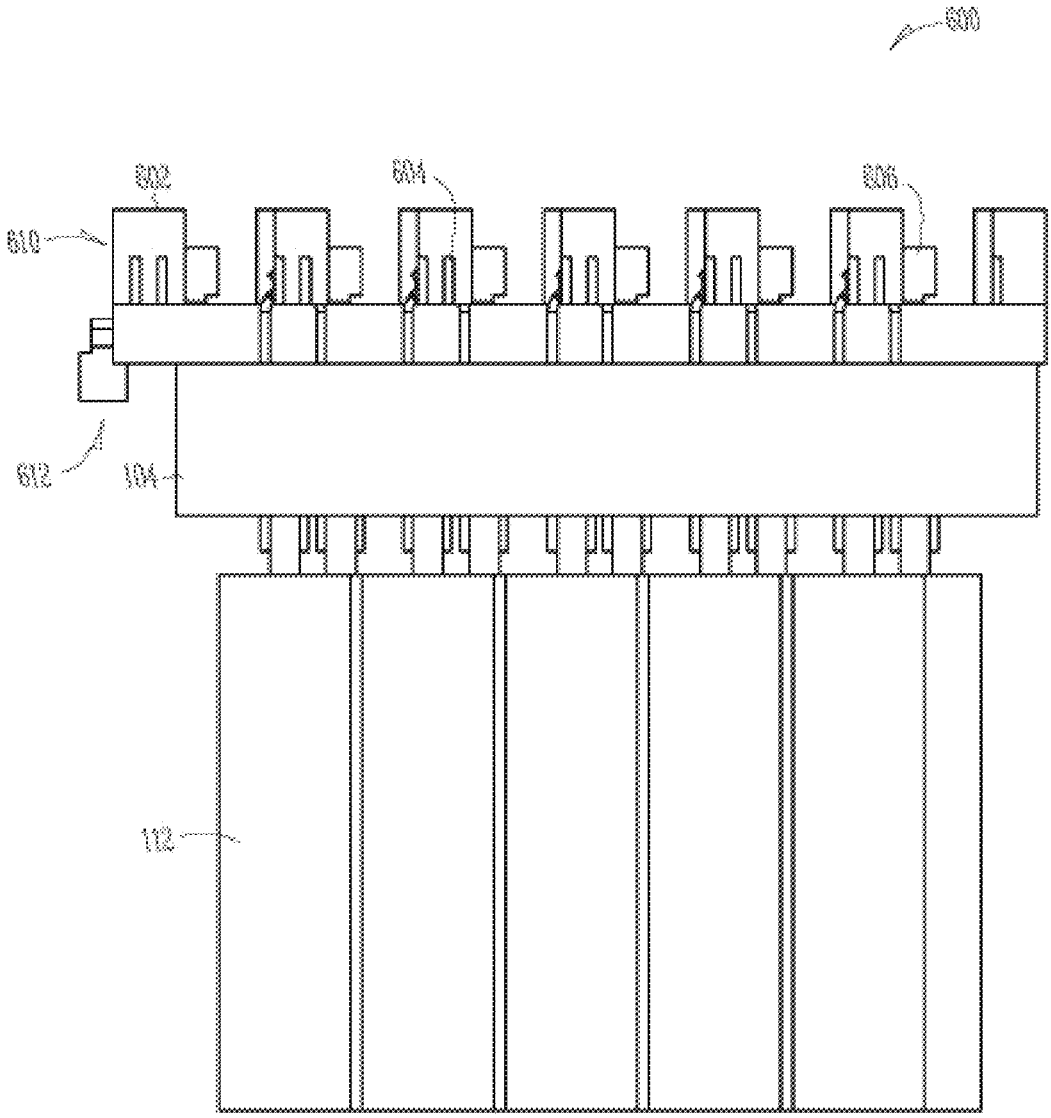

FIGS. 6A and 6B show an example of a connector assembly 600 with a two-row package-side connector 602. As illustrated, the cable-side connector 104 and cable 112 is the same as with connector assembly 100. In such an example, the connector assembly 600 does not provide pitch translation between the first conductive members 604 and the second conductive members 110.

In the illustrated example, the first conductive members 604 include pads 606, such as to couple to corresponding pads or contacts on a chip package or other contact point. In such an example, the pitch between the conductive members 604 is defined as the distance 608 between adjacent conductive members 604 in the same row 610, 612. However, factoring in the two rows 610, 612 of the connector 602, the pitch in the transverse direction of the connector 602 overall may be nevertheless be approximately half the pitch between adjacent conductive members within each row 610, 612, thereby reducing the overall substrate-side footprint of the connector 602 in comparison with if the connector, as illustrated, were a single row connector.

The connector 602 may otherwise include similar design elements to that of the connector 102. As illustrated, the connector includes a support structure 614 extending longitudinally along the connector 102, such as may provide mechanical support to the cable-side connector 104.

Figure 7:
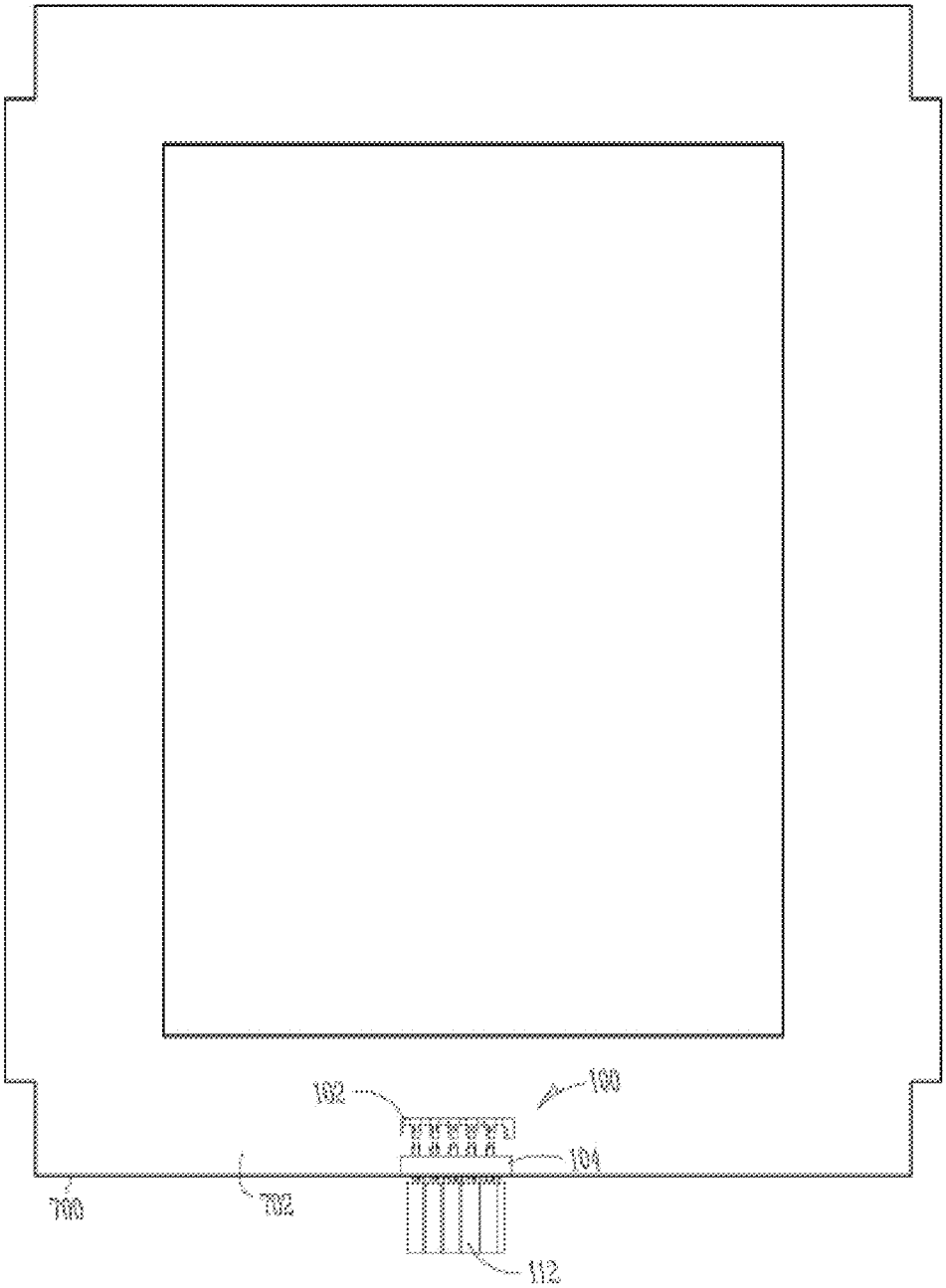
FIG. 7 is an image of a connector assembly on a chip package.

FIG. 7 is a depiction of the connector assembly 100 on a chip package 700. As illustrated, the connector assembly 100 couples to contacts (obscured) on a major surface 702, such as a topside major surface, of the chip package 700. Because of the approximately ninety (90) degree change in direction created by the connector assembly 100, the cables 112 and cable-side connector 104 may plug in to the package-side connector 102 by applying force in a direction generally parallel to a major plane of the major surface 702. The package-side connector 102 may be fixedly coupled to the chip package 700, such as by soldering the first conductive members 106 (obscured) to the contacts (obscured) of the chip package and/or through a mechanical fit, such as a releasable mechanical fit, between the connector 102 and the package 700. In various examples, no enabling mechanism may be needed to maintain the mechanical fit between the connectors 102, 104. Such may be the case because the vertical-to-horizontal translation provided by the connector assembly 100 may reduce mechanical pressure on the junction between the connectors 102, 104 relative to connectors that do not include directional translation.

In various alternative examples, the connector assembly 100 may include a unitary connector that combines the connectors 102, 104 as a single, non-separable piece. In such an example, the connector assembly would still include separate, albeit potentially non-separable, conductive members 106, 110 with the same orientation with respect to one another as disclosed herein. In such an example, each conductive member 106, 110 may be separately manufactureable and then secured with respect to one another at the interface surface 302 during manufacturing of the connector assembly. In such an example, electrical contacts of the cable 112 may be coupled to the connector assembly 100 and/or the connector assembly 100 may be coupled to the chip package 700, in either or both cases either fixedly or removably.

Figure 8:
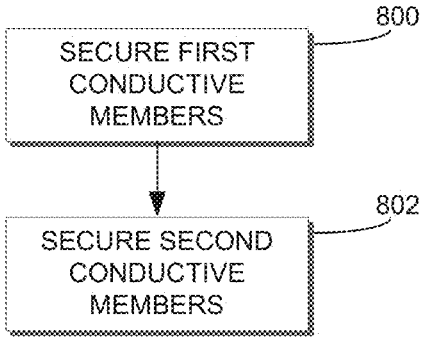
FIG. 8 is a flowchart for making a package.

FIG. 8 is a flowchart for making the connector assembly 100 and components thereof. The flowchart may be applied to the creation of a variety of connectors and connector assemblies in addition to the connector assembly 100. Additionally, the connector assembly 100 and components thereof may alternatively be made according to any of a variety of suitable methods.

At 800, a first plurality of conductive members 106 are secured with respect to one another in a first row 120. In an example, securing the first plurality of conductive members 106 secures the first plurality of conductive members 106 in a first connector 102, and At 802, a second plurality of conductive members 110 are secured with respect to one another, a first subset of the second plurality of conductive members forming a second row 122 and a second subset of the second plurality of conductive members different from the first subset forming a third row 124, the second and third rows 122, 124 being parallel and stacked with respect to one another and the second and third rows 122, 124 being orthogonal to the first row 120. In an example, securing the second plurality of conductive members 110 secures the second plurality of conductive members 110 in a second connector 104. In an example, individual ones of the first and second plurality of conductive members 106, 110 are arranged to be coupled at a first end 108, 114 to a corresponding one of a plurality of contacts. In an example, individual ones of the first plurality of conductive members 106 are arranged to be coupled to a corresponding individual one of the second plurality of conductive members 110 proximate a second end 116, 118 of each of the first and second plurality of conductive members 106, 110. In an example, the first connector 102 is arranged to be removably secured with respect to the second connector 104 to removably couple the corresponding individual ones of the first and second plurality of conductive members 106, 110.

In an example, the first connector 102 is arranged to be secured with respect to the second connector 104 to couple the corresponding individual ones of the first and second plurality of conductive members 106, 110. In an example, each of the first plurality of conductive members 106 has an interface surface 302 at which the first plurality of conductive members 106 couples to the second plurality of conductive members 110, and each of the first members 106 comprise a first subset of conductive members 106 having a first length 200 from the first end 108 to the interface surface 302 and a second subset of conductive members 106 having a second length 202 from the first end 108 to the interface surface 302, the second length 202 being shorter than the first length 200. In an example, the first plurality of conductive members 106 are adapted to couple to a plurality of contacts of a chip package 700 and the second plurality of conductive members 110 are adapted to couple to a plurality of contacts of a cable 112. In an example, the first and second plurality of conductive members 106, 110 are adapted to electrically couple individual ones of the plurality of contacts of the chip package 700 to individual ones of the plurality of contacts of the cable 112.

Figure 9:
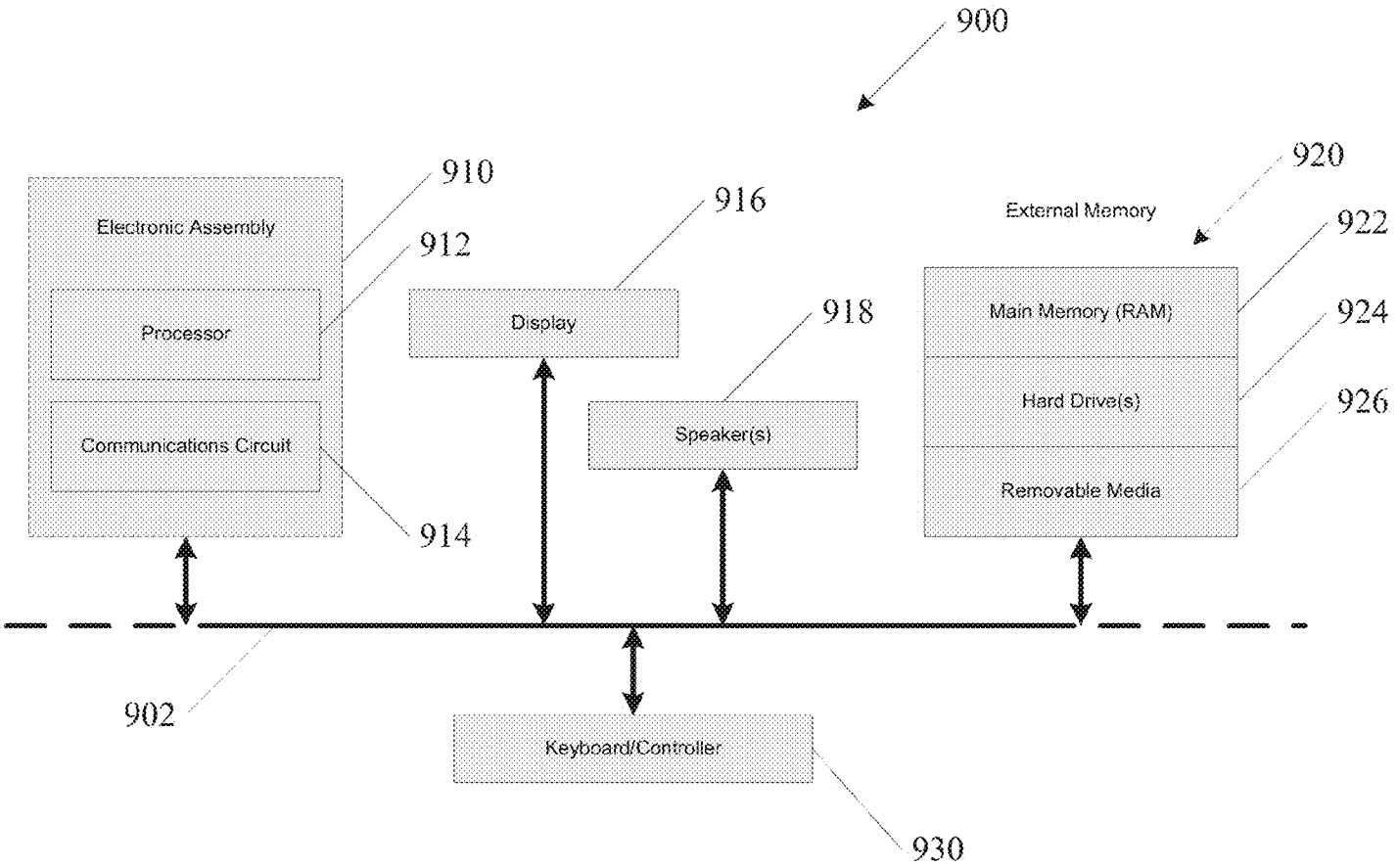
FIG. 9 is a block diagram of an electronic device incorporating at least one package.

An example of an electronic device using semiconductor chips and elongated structures as described in the present disclosure is included to show an example of a higher level device application for the present invention. FIG. 9 is a block diagram of an electronic device 900 incorporating at least one package, such as package 600 or other package described in examples herein. The electronic device 900 is merely one example of an electronic system in which embodiments of the present invention can be used. Examples of electronic devices 900 include, but are not limited to personal computers, servers, tablet computers, mobile telephones, personal data assistants, MP3 or other digital music players, etc. In this example, the electronic device 900 comprises a data processing system that includes a system bus 902 to couple the various components of the system. The system bus 902 provides communications links among the various components of the electronic device 900 and can be implemented as a single bus, as a combination of busses, or in any other suitable manner.

An electronic assembly 910 is coupled to the system bus 902. The electronic assembly 910 can include any circuit or combination of circuits. In one embodiment, the electronic assembly 910 includes a processor 912 which can be of any type. As used herein, "processor" means any type of computational circuit, such as but not limited to a microprocessor, a microcontroller, a complex instruction set computing (CISC) microprocessor, a reduced instruction set computing (RISC) microprocessor, a very long instruction word (VLIW) microprocessor, a graphics processor, a digital signal processor (DSP), multiple core processor, or any other type of processor or processing circuit.

Other types of circuits that can be included in the electronic assembly 910 are a custom circuit, an application-specific integrated circuit (ASIC), or the like, such as, for example, one or more circuits (such as a communications circuit 914) for use in wireless devices like mobile telephones, pagers, personal data assistants, portable computers, two-way radios, and similar electronic systems. The IC can perform any other type of function.

The electronic device 900 can also include an external memory 920, which in turn can include one or more memory elements suitable to the particular application, such as a main memory 922 in the form of random access memory (RAM), one or more hard drives 924, and/or one or more drives that handle removable media 926 such as compact disks (CD), digital video disk (DVD), and the like.

The electronic device 900 can also include a display device 916, one or more speakers 918, and a keyboard and/or controller 930, which can include a mouse, trackball, touch screen, voice-recognition device, or any other device that permits a system user to input information into and receive information from the electronic device 900.

Additional Examples

Example 1 may include subject matter (such as an apparatus, a method, a means for performing acts) that can include a first plurality of conductive members being secured with respect to one another and forming a first row and a second plurality of conductive members being secured with respect to one another, a first subset of the second plurality of conductive members forming a second row and a second subset of the second plurality of conductive members different from the first subset forming a third row, the second and third rows being parallel and stacked with respect to one another and the second and third rows being orthogonal to the first row. Individual ones of the first and second plurality of conductive members are arranged to be coupled at a first end to a corresponding one of a plurality of contacts. Individual ones of the first plurality of conductive members are arranged to be coupled to a corresponding individual one of the second plurality of conductive members proximate a second end of each of the first and second plurality of conductive members.

In Example 2, the connector assembly of Example 1 can optionally further include that the first plurality of conductive members are secured in a first connector and the second plurality of conductive members are secured in a second connector, wherein the first connector is arranged to be secured with respect to the second connector to couple the corresponding individual ones of the first and second plurality of conductive members.

In Example 3, the connector assembly of any one or more of Examples 1 and 2 can optionally further include that the first connector is arranged to be removably secured with respect to the second connector to removably couple the corresponding individual ones of the first and second plurality of conductive members.

In Example 4, the connector assembly of any one or more of Examples 1-3 can optionally further include that each of the first plurality of conductive members has an interface surface at which the first plurality of conductive members couples to the second plurality of conductive members, and wherein the first plurality of conductive members comprise a first subset of conductive members having a first length from the first end to the interface surface and a second subset of conductive members having a second length from the first end to the interface surface, the second length being shorter than the first length.

In Example 5, the connector assembly of any one or more of Examples 1-4 can optionally further include that the first plurality of conductive members are adapted to couple to a plurality of contacts of a chip package and the second plurality of conductive members are adapted to couple to a plurality of contacts of a cable.

In Example 6, the connector assembly of any one or more of Examples 1-5 can optionally further include that the first and second plurality of conductive members are adapted to electrically couple individual ones of the plurality of contacts of the chip package to individual ones of the plurality of contacts of the cable.

Example 7 may include subject matter (such as an apparatus, a method, a means for performing acts) that can include a major surface, a plurality of electrical connects positioned with respect to the major surface, and a package connector, comprising a first plurality of conductive members being secured with respect to one another and forming a first row. The first plurality of conductive members are adapted to be coupled to a second plurality of conductive members, the second plurality of conductive members being secured with respect to one another, a first subset of the second plurality of conductive members forming a second row and a second subset of the second plurality of conductive members different from the first subset forming a third row, the second and third rows being parallel and stacked with respect to one another and the second and third rows being orthogonal to the first row.

In Example 8, the chip package of Example 7 can optionally further include that the first plurality of conductive members are secured in a first connector and the second plurality of conductive members are secured in a second connector, wherein the first connector is arranged to be secured with respect to the second connector to couple the corresponding individual ones of the first and second plurality of conductive members.

In Example 9, the chip package of any one or more of Examples 7 and 8 can optionally further include that the first connector is arranged to be removably secured with respect to the second connector to removably couple the corresponding individual ones of the first and second plurality of conductive members.

In Example 10, the chip package of any one or more of Examples 7-9 can optionally further include that each of the first plurality of conductive members has an interface surface at which the first plurality of conductive members couples to the second plurality of conductive members, and wherein the first plurality of conductive members comprise a first subset of conductive members having a first length from the first end to the interface surface and a second subset of conductive members having a second length from the first end to the interface surface, the second length being shorter than the first length.

In Example 11, the chip package of any one or more of Examples 7-10 can optionally further include that the second plurality of conductive members are adapted to couple to a plurality of contacts of a cable.

In Example 12, the chip package of any one or more of Examples 7-11 can optionally further include that the first and second plurality of conductive members are adapted to electrically couple individual ones of the plurality of contacts of the chip package to individual ones of the plurality of contacts of the cable.

Example 13 may include subject matter (such as an apparatus, a method, a means for performing acts) that can include securing a first plurality of conductive members with respect to one another in a first row and securing a second plurality of conductive members with respect to one another, a first subset of the second plurality of conductive members forming a second row and a second subset of the second plurality of conductive members different from the first subset forming a third row, the second and third rows being parallel and stacked with respect to one another and the second and third rows being orthogonal to the first row. Individual ones of the first and second plurality of conductive members are arranged to be coupled at a first end to a corresponding one of a plurality of contacts. Individual ones of the first plurality of conductive members are arranged to be coupled to a corresponding individual one of the second plurality of conductive members proximate a second end of each of the first and second plurality of conductive members.

In Example 14, the chip package of Example 13 can optionally further include that securing the first plurality of conductive members secures the first plurality of conductive members in a first connector, wherein securing the second plurality of conductive members secures the second plurality of conductive members in a second connector, and wherein the first connector is arranged to be secured with respect to the second connector to couple the corresponding individual ones of the first and second plurality of conductive members.

In Example 15, the chip package of any one or more of Examples 13 and 14 can optionally further include that the first connector is arranged to be removably secured with respect to the second connector to removably couple the corresponding individual ones of the first and second plurality of conductive members.

In Example 16, the chip package of any one or more of Examples 13-15 can optionally further include that each of the first plurality of conductive members has an interface surface at which the first plurality of conductive members couples to the second plurality of conductive members, and wherein the first plurality of conductive members comprise a first subset of conductive members having a first length from the first end to the interface surface and a second subset of conductive members having a second length from the first end to the interface surface, the second length being shorter than the first length.

In Example 17, the chip package of any one or more of Examples 13-16 can optionally further include that the first plurality of conductive members are adapted to couple to a plurality of contacts of a chip package and the second plurality of conductive members are adapted to couple to a plurality of contacts of a cable.

In Example 18, the chip package of any one or more of Examples 13-17 can optionally further include that the first and second plurality of conductive members are adapted to electrically couple individual ones of the plurality of contacts of the chip package to individual ones of the plurality of contacts of the cable.

Each of these non-limiting examples can stand on its own, or can be combined with one or more of the other examples in any permutation or combination.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A connector assembly, comprising:

a first plurality of conductive members being secured with respect to one another and forming a first row; and a second plurality of conductive members being secured with respect to one another, a first subset of the second plurality of conductive members forming a second row and a second subset of the second plurality of conductive members different from the first subset forming a third row, the second and third rows being parallel and stacked with respect to one another and the second plurality of conductive members being orthogonal to the first plurality of conductive members;

wherein individual ones of the first and second plurality of conductive members are arranged to be coupled at a first end to a corresponding one of a plurality of contacts; and wherein individual ones of the first plurality of conductive members are arranged to be coupled to a corresponding individual one of the second plurality of conductive members proximate a second end of each of the first and second plurality of conductive members.

2. The connector assembly of claim 1, wherein the first plurality of conductive members are secured in a first connector and the second plurality of conductive members are secured in a second connector, wherein the first connector is arranged to be secured with respect to the second connector to couple the corresponding individual ones of the first and second plurality of conductive members.

3. The connector assembly of claim 2, wherein the first connector is arranged to be removably secured with respect to the second connector to removably couple the corresponding individual ones of the first and second plurality of conductive members.

4. The connector assembly of claim 1, wherein each of the first plurality of conductive members has an interface surface at which the first plurality of conductive members couples to the second plurality of conductive members, and wherein the first plurality of conductive members comprise:

a first subset of conductive members having a first length from the first end to the interface surface; and a second subset of conductive members having a second length from the first end to the interface surface, the second length being shorter than the first length.

5. The connector assembly of claim 1, wherein the first plurality of conductive members are adapted to couple to a plurality of contacts of a chip package and the second plurality of conductive members are adapted to couple to a plurality of contacts of a multiple conductor cable.

6. The connector assembly of claim 5, wherein the first and second plurality of conductive members are adapted to electrically couple individual ones of the plurality of contacts of the chip package to individual ones of the plurality of contacts of the cable.

7. The connector assembly of claim 1, wherein the first plurality of conductive members are substantially straight from the first end to the second end within a major plane of the first row.

8. A chip package, comprising:

a major surface;

a plurality of electrical connects positioned with respect to the major surface;

a package connector, comprising first plurality of conductive members being secured with respect to one another and forming a first row; and wherein the first plurality of conductive members are adapted to be coupled to a second plurality of conductive members, the second plurality of conductive members being secured with respect to one another, a first subset of the second plurality of conductive members forming a second row and a second subset of the second plurality of conductive members different from the first subset forming a third row, the second and third rows being parallel and stacked with respect to one another and the second plurality of conductive members being orthogonal to the first plurality of conductive members.

9. The chip package of claim 8, wherein the first plurality of conductive members are secured in a first connector and the second plurality of conductive members are secured in a second connector, wherein the first connector is arranged to be secured with respect to the second connector to couple the corresponding individual ones of the first and second plurality of conductive members.

10. The chip package of claim 9, wherein the first connector is arranged to be removably secured with respect to the second connector to removably couple the corresponding individual ones of the first and second plurality of conductive members.

11. The chip package of claim 8, wherein each of the first plurality of conductive members has an interface surface at which the first plurality of conductive members couples to the second plurality of conductive members, and wherein the first plurality of conductive members comprise:

a first subset of conductive members having a first length from the first end to the interface surface; and a second subset of conductive members having a second length from the first end to the interface surface, the second length being shorter than the first length.

12. The chip package of claim 8, the second plurality of conductive members are adapted to couple to a plurality of contacts of a multiple conductor cable.

13. The chip package of claim 12, wherein the first and second plurality of conductive members are adapted to electrically couple individual ones of the plurality of contacts of the chip package to individual ones of the plurality of contacts of the cable.

14. The chip package of claim 8, wherein the first plurality of conductive members are substantially straight from the first end to the second end within a major plane of the first row.

15. A method for making a connector assembly, comprising:

securing a first plurality of conductive members with respect to one another in a first row; and securing a second plurality of conductive members with respect to one another, a first subset of the second plurality of conductive members forming a second row and a second subset of the second plurality of conductive members different from the first subset forming a third row, the second and third rows being parallel and stacked with respect to one another and the second plurality of conductive members being orthogonal to the first plurality of conductive members;

wherein individual ones of the first and second plurality of conductive members are arranged to be coupled at a first end to a corresponding one of a plurality of contacts; and wherein individual ones of the first plurality of conductive members are arranged to be coupled to a corresponding individual one of the second plurality of conductive members proximate a second end of each of the first and second plurality of conductive members.

16. The method of claim 15, wherein securing the first plurality of conductive members secures the first plurality of conductive members in a first connector, wherein securing the second plurality of conductive members secures the second plurality of conductive members in a second connector, and wherein the first connector is arranged to be secured with respect to the second connector to couple the corresponding individual ones of the first and second plurality of conductive members.

17. The method of claim 16, wherein the first connector is arranged to be removably secured with respect to the second connector to removably couple the corresponding individual ones of the first and second plurality of conductive members.

18. The method of claim 15, wherein each of the first plurality of conductive members has an interface surface at which the first plurality of conductive members couples to the second plurality of conductive members, and wherein the first plurality of conductive members comprise:

a first subset of conductive members having a first length from the first end to the interface surface; and a second subset of conductive members having a second length from the first end to the interface surface, the second length being shorter than the first length.

19. The method of claim 15, wherein the first plurality of conductive members are adapted to couple to a plurality of contacts of a chip package and the second plurality of conductive members are adapted to couple to a plurality of contacts of a multiple conductor cable.

20. The method of claim 19, wherein the first and second plurality of conductive members are adapted to electrically couple individual ones of the plurality of contacts of the chip package to individual ones of the plurality of contacts of the cable.

21. The method of claim 15, wherein the first plurality of conductive members are substantially straight from the first end to the second end within a major plane of the first row.

* * * * *

UNITED STATES PATENT AND TRADEMARK OFFICE

CERTIFICATE OF CORRECTION

PATENT NO. : 9,017,106 B2
APPLICATION NO. : 13/826393
DATED : April 28, 2015
INVENTOR(S) : Heppner et al.

It is certified that error appears in the above-identified patent and that said Letters Patent is hereby corrected as shown below:

In the claims

In column 12, line 1, in Claim 8, before "first", insert --a--, therefor

Signed and Sealed this
Seventh Day of June, 2016

Michelle K. Lee

Michelle K. Lee
*Director of the United States Patent and Trademark Office*